US009066541B2

(12) United States Patent
Allen et al.

(10) Patent No.: US 9,066,541 B2
(45) Date of Patent: Jun. 30, 2015

(54) PLUG SPACE PLUG FILTER WITH FLAVOR BEAD

(75) Inventors: Jeffrey Lynn Allen, Midlothian, VA (US); Dwight D. Williams, Powhatan, VA (US); Herbert Carrington Longest, Jr., Midlothian, VA (US); Robert E. Lee, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 994 days.

(21) Appl. No.: 13/071,699

(22) Filed: Mar. 25, 2011

(65) Prior Publication Data

US 2012/0037172 A1 Feb. 16, 2012

Related U.S. Application Data

(60) Provisional application No. 61/318,248, filed on Mar. 26, 2010.

(51) Int. Cl.

| | |
|---|---|
| ***A24D 1/00*** | (2006.01) |
| ***A24D 3/04*** | (2006.01) |
| ***A24D 3/06*** | (2006.01) |

(52) U.S. Cl.
CPC . *A24D 3/04* (2013.01); *A24D 3/061* (2013.01)

(58) Field of Classification Search
CPC ..... A24D 1/002; A24D 1/045
USPC ..... 131/275
See application file for complete search history.

(56) References Cited

U.S. PATENT DOCUMENTS

| | | | | |
|---|---|---|---|---|
| 3,366,121 | A * | 1/1968 | Carty | 131/337 |
| 3,428,049 | A * | 2/1969 | Cogbill et al. | 131/337 |
| 3,575,180 | A * | 4/1971 | Carty | 131/337 |
| 3,596,665 | A * | 8/1971 | Lindgard | 131/337 |
| 5,263,999 | A | 11/1993 | Baldwin et al. | |
| 5,997,691 | A | 12/1999 | Gautam et al. | |
| 7,699,061 | B2 | 4/2010 | Seitert et al. | |
| 7,878,962 | B2 | 2/2011 | Karles et al. | |
| 2003/0098033 | A1 * | 5/2003 | Macadam et al. | 131/344 |
| 2007/0000505 | A1 | 1/2007 | Zhuang et al. | |
| 2007/0012327 | A1 | 1/2007 | Karles et al. | |

FOREIGN PATENT DOCUMENTS

EP 0 232 166 A2 8/1987

OTHER PUBLICATIONS

International Preliminary Report on Patentability mailed Oct. 11, 2012 for PCT/IB2011/001107.

(Continued)

*Primary Examiner* — Cynthia Szewczyk
(74) *Attorney, Agent, or Firm* — Buchanan Ingersoll & Rooney PC

(57) ABSTRACT

A filter component for a smoking article includes an upstream segment of filter material, a downstream segment of filter material in a spaced apart relation to the upstream segment of filter material so as to define a cavity therebetween, and a flavor bead disposed in the cavity. The flavor bead has an outer diameter, which is at least 75% of the spaced apart relation of the upstream segment of filter material and the downstream segment of filter material. The outer diameter of the flavor bead does not exceed an outer diameter of either the upstream or downstream segments of filter material.

10 Claims, 3 Drawing Sheets

(56) References Cited

OTHER PUBLICATIONS

Official Action for corresponding Japanese Patent Appln. No. 2013-501984.

International Search Report and Written Opinion mailed Sep. 2, 2011 for International Application No. PCT/IB2011/001107.

* cited by examiner

PLUG SPACE PLUG FILTER WITH FLAVOR BEAD

CROSS REFERENCE TO RELATED APPLICATION

This application claims priority under 35 U.S.C. §119(e) to U.S. Provisional Application No. 61/318,248, filed on Mar. 26, 2010, the entire content of which is incorporated herein by reference thereto.

WORKING ENVIRONMENT

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The tobacco rod is generally about 6.0 millimeters to about 10.0 millimeters in diameter and about 50 millimeters to about 125 millimeters in length.

Typically, the filter includes a plug of cellulose acetate tow attached to the tobacco rod by tipping paper. Ventilation of mainstream smoke can be achieved with a row or rows of perforations about a location along the filter.

When flavorants such as menthol are applied to cigarette filter in the form of a solution, staining or spotting of the outer surface of the cigarette can occur, particularly at high loadings of menthol in large amounts of solvent. Further, such a direct application of flavorants such as menthol to the cigarette filter does not allow for the regulation of menthol release during smoking and can lead to migration and loss of menthol during storage of the cigarette.

Accordingly, it would be desirable to provide a filter component for a smoking article, which provides added flavorant such as menthol to the mainstream smoke and can be easily manufactured and produced with existing filter forming equipment.

SUMMARY

In accordance with an exemplary embodiment, a filter component for a smoking article, comprises: an upstream segment of filter material; a downstream segment of filter material in a spaced apart relation to the upstream segment of filter material so as to define a cavity therebetween; and a flavor bead disposed in the cavity. The flavor bead preferably has an outer diameter, which is at least 75% of the spaced apart relation of the upstream segment of filter material and the downstream segment of filter material and wherein the outer diameter of the flavor bead does not exceed an outer diameter of either the upstream or downstream segments of filter material.

In accordance with another exemplary embodiment, a smoking article comprises: a tobacco rod; and a multi-component filter comprising: an upstream segment of filter material; a downstream segment of filter material in a spaced apart relation to the upstream segment of filter material so as to define a cavity therebetween; a flavor bead disposed in the cavity, and wherein the flavor bead has an outer diameter, which is at least 75% of the spaced apart relation of the upstream segment of filter material and the downstream segment of filter material and wherein the outer diameter of the flavor bead does not exceed an outer diameter of either the upstream or downstream segments of filter material; and a filter wrapper which circumscribes the upstream segment of filter material, the downstream segment of filter material and the flavor bead.

In accordance with a further exemplary embodiment, a method of manufacturing a filter component comprises the steps of: dispensing a first filter segment having a first length onto a filter rod forming portion of a filter rod forming apparatus; dispensing a second filter segment having a second length in a spaced apart relationship to the first filter segment so as to define a cavity therebetween onto the filter rod forming portion; placing a flavor bead within the cavity; and circumscribing the first filter segment, the second filter segment and the flavor bead with a filter wrapper.

The drawings are exemplary only, and should not be construed as limiting the various embodiments set forth herein.

DETAILED DESCRIPTION

Figure 1:
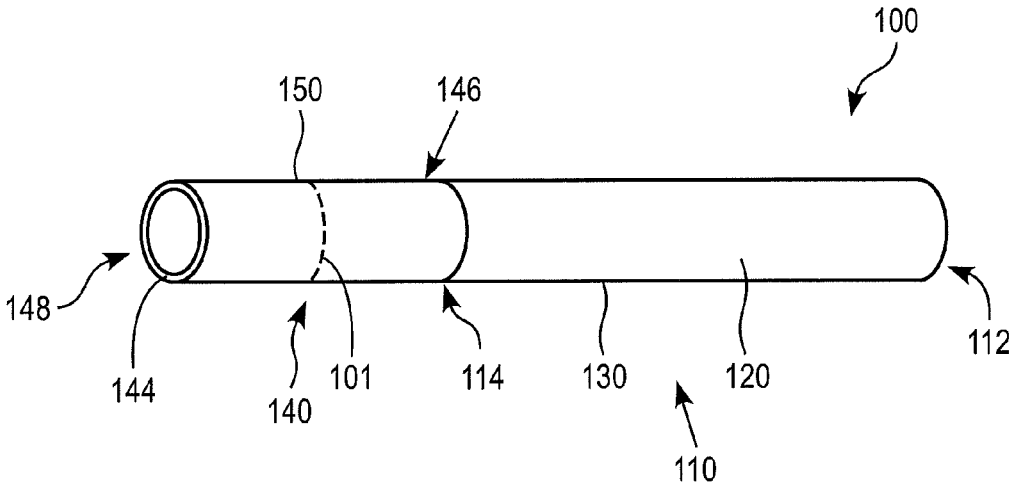
FIG. 1 is a perspective view of a smoking article in accordance with an embodiment.

In accordance with an exemplary embodiment, as shown in FIG. 1, a smoking article 100 includes a generally cylindrical rod 110 of smoking material 120 (shown in FIG. 2), contained in a circumscribing outer wrapper 130. The outer wrapper 130 is typically a porous wrapping material or paper wrapper. The rod 110 is typically referred to as a "tobacco rod" and has a lit end 112 and a mouth end 114. As such, the tobacco rod 110 burns back from the lit end 112 thereof towards the opposite end (i.e., mouth end 114) thereof, and the smoking material 120 of the tobacco rod 110 is consumed by combustion during the smoking period. The smoking material 120 is preferably a shredded tobacco or tobacco cut filler. However, any suitable smoking material 120 can be used.

The smoking article 100 also includes a filter system 140 adjacent to the mouth end 114 of the tobacco rod 110 such that the filter system 140 and tobacco rod 110 are axially aligned in an end-to-end relationship, preferably abutting one another. The filter system 140 has a generally cylindrical shape, and the diameter thereof is essentially equal to the diameter of the tobacco rod 110. The ends (i.e., upstream end 146 (shown in FIG. 2) and downstream end 148) of the filter system 140 are open to permit the passage of air and smoke therethrough. It can be appreciated that the smoking article 100, which includes the tobacco rod 110 and the filter system 140 is generally about 6.0 millimeters to 10.0 millimeters in diameter and about 75 millimeters to 150 millimeters in length.

Herein, the "upstream" and "downstream" relative positions between filter segments and other features are described in relation to the direction of mainstream smoke as it is drawn from the tobacco rod 110 and through the filter system 140.

In accordance with an exemplary embodiment, the filter system 140 includes a plurality of filter segments 230, 240 (FIG. 2) circumscribed by a filter wrapper (or plug wrap) 144. The filter wrapper (or plug wrap) 144 is preferably a paper which optionally incorporates a carbonaceous material. Preferably, the filter wrapper (or plug wrap) 144 circumscribes the total length of the filter system 140. The filter system 140 is attached to the tobacco rod 110 by a tipping material 150, which circumscribes both the entire length of the filter system 140 and an adjacent region of the tobacco rod 110. The tipping material 150 is typically a paper like product; however, any suitable material can be used. The inner surface of the tipping material 150 is fixedly secured to the outer surface of the filter wrapper (or plug wrap) 144 and the outer surface of the wrapping material 130 of the tobacco rod 120, using a suitable adhesive. A ventilated or air diluted smoking article can be provided with an air dilution means, such as a series of ventilation holes or perforations 101, each of which extend through the tipping material 150 and optionally the filter wrapper (or plug wrap) 144.

Figure 2:
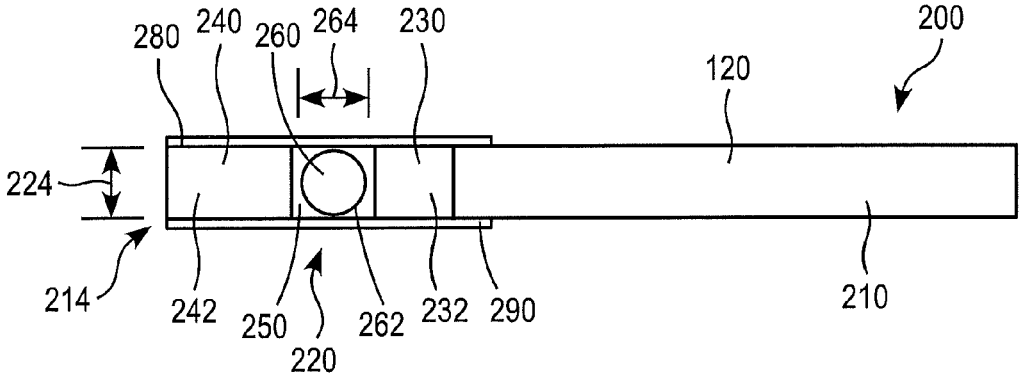
FIG. 2 is a cross-sectional view of a smoking article in accordance with one embodiment.

In accordance with an exemplary embodiment as shown in FIG. 2, the smoking article 200 includes a tobacco rod 210 and a filter system (or multi-component filter) 220, which comprises a plug-space-plug filter sub-assembly that includes an upstream filter component 230, a downstream filter component 240 in spaced apart relation to the upstream filter component 230 so as to define a cavity 250 therebetween, and a flavor bead 260 disposed in the cavity 250. The upstream filter component 230 is located adjacent the tobacco rod 210 and preferably, comprises a plug of cellulose acetate tow 232 of low resistance to draw ("RTD") or other suitable fibrous or webbed material of moderate to low particulate efficiency. In accordance with an exemplary embodiment, the upstream filter component 230 is made as short as possible within the limits of high-speed machineability and preferably has the lowest particulate RTD amongst the filter components comprising the multi-component filter.

The downstream filter component 240 (or mouth end (buccal) component) is preferably in the form of a cellulose acetate plug 242 or other suitable fibrous or webbed material of moderate to low particulate efficiency. Preferably, the particulate efficiency is low, with the denier and grand total denier being selected such that the desired total RTD of the filter is achieved.

Preferably, one or more circumferential rows of perforations (not shown) are formed through the filter wrapper 280 and the tipping paper 290 at a location along the filter 220, preferably at an upstream end portion of the filter 220. In accordance with an exemplary embodiment, the placement of the one or more circumferential rows of perforations is at a maximum distance between the buccal end (or mouth end) 214 of the smoking article 200 and the perforations, which preferably is at least 12 mm (millimeters) or more, so that a smoker's lips do not occlude the perforations. Furthermore, because the introduction of diluting air flows at an upstream end portion of the filter 220, itself, lowers the particulate efficiency of the downstream portions of the segment, the upstream location of the ventilation along the filter component facilitates design of the component to provide a more elevated (yet moderate) RTD without a significant elevation of particulate efficiency, so as to help maintain a desired low particulate efficiency in the central component and throughout the filter.

In accordance with an exemplary embodiment as shown in FIG. 2, the length of tobacco rod 210 is about 50 mm to about 80 mm, and more preferably about 55 mm to about 65 mm, and most preferably about 56 mm in length. The length of the filter 220 is preferably about 20 mm to about 35 mm and more preferably about 27 mm in length. The length of the filter components of the smoking article in an embodiment is as follows: the upstream filter component 230 is preferably about 7 mm; the space or cavity 250, which encapsulates the flavor bead 260 is preferably about 6 mm; and the downstream filter component (i.e., mouth end component) 240 is preferably about 14 mm. Also preferably, the upstream filter component 230, the flavor bead 240, and the downstream filter component 240 are surrounded or circumscribed by the filter wrapper 280.

It can be appreciated that the upstream and downstream filter components 230, 240 are preferably of low particulate efficiency. Also preferably, amongst all the fibrous or web segments, the upstream end component is of lowest RTD and particulate efficiency, because it is upstream of the ventilation and therefore has greater effect upon the mainstream smoke. Unlike those other fibrous or webbed components, the upstream end component receives the mainstream smoke in the absence of a diluting air stream.

Although certain dimensions are disclosed with reference to the embodiments shown, such dimensions can be varied to provide different configurations related to the upstream and the downstream filter components 230, 240 and the flavor bead 260 within the filter 220.

The tobacco rod 210 may be wrapped with a conventional cigarette wrapper or banded paper can be used for this purpose. Banded cigarette paper has spaced apart integrated cellulose bands that encircle the finished tobacco rod of cigarette to modify the mass burn rate of the cigarette so as to reduce risk of igniting a substrate if the smoking article is left thereon smoldering. U.S. Pat. Nos. 5,263,999 and 5,997,691 describe banded cigarette paper, which patents are incorporated herein in their entirety for all purposes.

In accordance with an exemplary embodiment, the flavor bead 260 is in the form of a tobacco bead. In accordance with an exemplary embodiment, the flavor bead 260 consists essentially of tobacco particles, water and optional flavorants but without added binder ingredients. The flavor bead can be extruded and/or spheronized. In the alternative, the flavor bead 260 may further contain an added binder ingredient, wherein the binder is preferably a cellulosic material. A preferred cellulosic material is microcrystalline cellulose. Additional dry and liquid binders may be present in the beads as well as additional flavorants and fillers. If desired, the flavor bead 260 can include one or more coatings 262. Flavorants such as menthol crystals can be used to form a mentholated flavor bead, and/or other flavorants can also be added to the flavor bead 260 and/or to the coatings 262 of the bead 260. However, as noted above, the flavor bead 260 preferably is a bead comprising tobacco particles and water that is held together without addition of a binder additive other than water.

Not wishing to be bound by theory, at the downstream location of the flavor bead 260, the temperature of tobacco smoke passing through the filter is in a cooled condition, essentially at or about room temperature. Despite the absence of heat from the cigarette coal (or any addition of moisture), it has been found that a flavor bead 260 is effective in releasing flavor into the mainstream smoke so as to produce a flavored smoke. The flavors released from the flavor bead 260 are flavors specific to the tobacco source and/or flavors added to the bead 260 during their production. The organoleptic notes from using a flavor bead 260 are associated with enhanced tobacco character. Preferably, the flavors from the tobacco particulates and/or flavor components are released into the mainstream tobacco smoke under essentially ambient conditions.

In accordance with an exemplary embodiment, the flavor bead 260 can be a crushable capsule or bead, wherein the flavor bead releases at least a portion of the flavorant or additive material, such as menthol when the filter 220 is subjected to an external force.

In accordance with an exemplary embodiment, the flavor beads 260 are preformed. Flavorants can be included during the process of making the flavor or can be later added to the beads. Alternatively or in addition, flavorants can be added to a coating on the bead 260, said coating having perhaps the additional function of providing a controlled release of the components in the beads 260. Volatile flavorants can be added during the process of preparing the beads or to the preformed beads, depending on the process used for preparing the beads. Depending on the method of preparing the beads 260, it may be more preferable to add volatile flavorants to the preformed beads rather than during the process of preparing the beads. Liquid compounds can be added to the beads 260 by for example impregnating the beads with liquid formulations containing for example volatile flavors, diluents, and the like. Alternatively, compounds and compositions can be added to the beads by mixing the beads or by fluidized bed spraying of the beads or by other suitable methods.

It can also be appreciated that the functionality of the flavor bead 260 can be tailored to have more of controlled-delivery release of active compounds. For example, diffusion of the flavors from the bead 260 can be adjusted by bead porosity and density as well as by any controlled-release coating added to the beads. For instance, the beads 260 can be overcoated with polymeric coatings of different functionalities and or compositions (e.g., single or multiple overcoats depending on the application) to control the delivery and release of the active compounds.

In another aspect, the flavor bead 260 can act as a delivery system for delivering flavors naturally occurring in the components of the bead formulation. Alternatively, the flavor beads can act as a medium for creating and/or enhancing naturally occurring flavors through Maillard, enzymatic, or other types of reactions. It is further contemplated that the beads 260 can be altered or enhanced by thermal treatment of the beads 260 after formation. The thermal treatment can further enhance reactions such as Maillard reactions and enzymatic reactions and thereby flavors of the smoking article containing said beads.

Another embodiment contemplates that the flavor bead 260 can be further enhanced by adding additives during the bead making process. This can include additives such as flavors as well as components which would enhance the formation of flavors by reactions such as Maillard reactions between the components to naturally enhance the smoke. The optional flavorant includes flavor materials that are practically unlimited, although water-soluble, alcohol-soluble and oil-soluble flavors are preferable. Typical flavors include lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, and coffee. Each of the flavors can be used singly or mixed with others. If desired, diluent agents can be added to the tobacco beads. Diluent agents which can be used for this purpose include powdered starch, such as but not limited to corn starch and potato starch, rice powder, calcium carbonate, diatomaceous earth, talc, acetate powder, and pulp flock. The optional flavorant can also be in the form of a solid matrix (liquid flavorants spray dried with a starch). The optional flavorant can also be in the form of solids, liquids or gels. The optional flavorant can be present in the tobacco beads in an amount of up to about 50% by weight (e.g., 0.1 to 5%, 5 to 10%, 10 to 15%, 15 to 20%, 20 to 25%, 25 to 30%, 30 to 35%, 35 to 40%, 40 to 45% or 45 to 50%).

For tobacco particles containing additive binder such as a non-tobacco cellulosic material, microcrystalline cellulose (MCC) is the preferred cellulosic material in combination with tobacco particles. Whereas various flavor carriers may need heat or water to release volatile flavor compounds into mainstream smoke, cellulosic binder containing flavor beads and/or tobacco beads 260 can release such flavor constituents under ambient conditions.

The flavor beads 260 are preferably in the form of "spheroids" having diameters in the range of about 3.5 to about 10.0 mm, more preferably from about 4.0 to about 7.0 mm and most preferably from about 4.5 to about 5.0 mm (and any 0.1 value in between these ranges). The flavor bead 260 (or spheroids) can be round or oval in structure. In accordance with an exemplary embodiment, the flavor bead 260 preferably has an outer diameter, which is at least 75% of the spaced apart relation of the upstream segment of filter material (or upstream filter segment) 230 and the downstream segment of filter material (or downstream filter segment) 240 and wherein the outer diameter of the flavor bead 260 does not exceed an outer diameter of either the upstream or downstream segments of filter material 230, 240.

It can be appreciated that the flavor bead 260 in the form of a tobacco bead can be used to flavor mainstream smoke in cigarettes, which allows a standard tobacco mixture to be used in the tobacco rod of a standard lit-end cigarette and the desired taste attributes of different cigarette products (e.g., regular, mild, full flavor, etc.) to be provided by a tobacco bead 260, which contain flavorant effective to achieve the desired taste of the mainstream smoke.

The preferred embodiments are merely illustrative and should not be considered restrictive in any way. The scope of the invention is given by the appended claims, rather than the preceding description, and all variations and equivalents which fall within the range of the claims are intended to be embraced therein. Moreover, the present invention may be practiced with cigarettes of various circumferences, narrow cigarettes as well as wide. Also, while the present invention is preferably practiced with unflavored tobacco rods, flavored tobacco filler is also contemplated.

As used herein, the term "about" and/or "approximately" when used in conjunction with a stated numerical value or range denotes somewhat more or somewhat less than the stated value or range, to within a range of ±10% of that stated.

Figure 3:
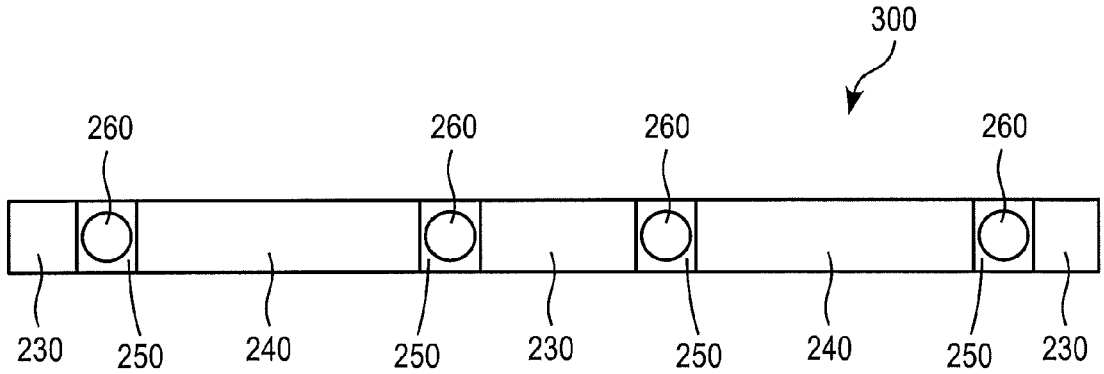
FIG. 3 is a cross-sectional view of a filter rod in accordance with an embodiment.

It can be appreciated that the filter 220 can be manufactured by making and filling upstream and downstream plug-space-plug sections in sequence or simultaneously. For instance as shown in FIG. 3, a continuous filter rod 300 can be manufactured with repeating segments corresponding to the upstream filter segment 230, the cavity 250 containing a flavor bead 260 and a downstream filter segment 240, which is twice the desired length of the downstream filter segment 240, which are placed on a filter rod forming portion of a filter forming apparatus (or filter combiner). A second cavity 250 containing a flavor bead 260, another upstream filter segment 230, which is twice the desired length of the upstream filter segment 230, a third cavity 250 containing a flavor bead 260, another downstream filter segment 240, which is twice the desired length of the downstream filter segment 240, a fourth cavity 250 with a flavor bead 260 and an upstream segment of filter material is added to the filter rod forming portion of the filter rod apparatus. The segments 230, 240 and each of the cavities 250 with a flavor bead 260 are then circumscribed within a filter wrapper (or plug wrap) and cut into individual filter components 220 as shown in FIG. 2.

As shown in FIG. 3, the continuous filter rod 300 is about 108 mm in length and upon cutting into individual filter components 220 comprises four (4) filter components 220 of approximately 27 mm in length. In accordance with an exemplary embodiment, each of the four (4) individual filter components 220 comprise an upstream filter segment 230, which is about 7 mm in length, a downstream filter segment 240, which is about 14 mm in length, and a flavor bead 260 within a cavity 250. In accordance with an embodiment, the cavity 250 is about 6 mm in length. As set forth above, although certain dimensions are disclosed with reference to the embodiments shown, such dimensions can be varied to provide different configurations related to the upstream and the downstream filter components 230, 240 and the flavor bead 260 within the filter 220.

In accordance with an exemplary embodiment, the flavor bead 260 has an outer diameter 264, which is at least 75% of the spaced apart relation of the upstream segment of filter material 230 and the downstream segment of filter material 240 and wherein the outer diameter 264 of the flavor bead 260 does not exceed an outer diameter 224 of the filter component 200 and/or the upstream or the downstream segments of filter material 230, 240. For example, for a cavity 250 which is about 6 mm in length, the flavor bead 260 preferably has an outer diameter 264 of about 4.5 mm or greater.

Figure 4:
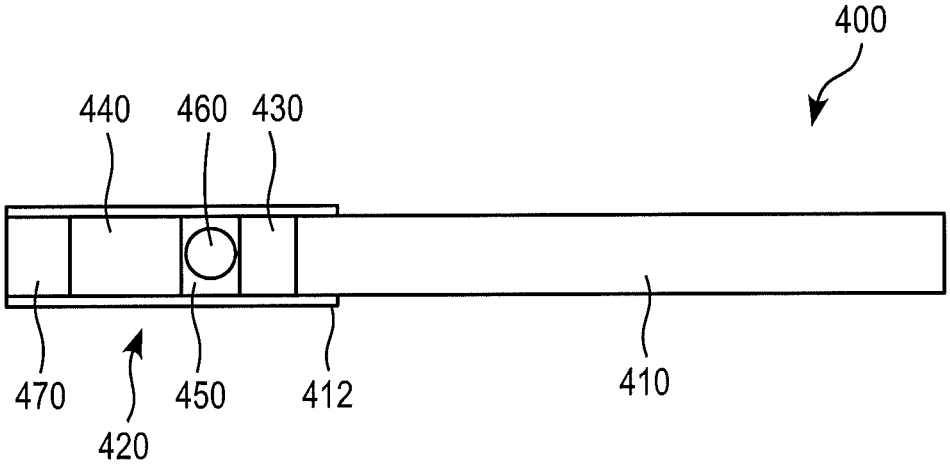
FIG. 4 is a cross-sectional view of a smoking article in accordance with a further embodiment.

In accordance with another embodiment, as shown in FIG. 4, a smoking article 400 includes a tobacco rod 410, which is about 58 mm long, and a filter or filter component 420, which is about 25 mm long held together by tipping paper 412. The filter 420 includes an upstream segment of filter material 430 in a spaced apart relationship to a downstream segment of filter material 440 so at to define a cavity 450 containing a flavor bead 460, and a recess 470 at the downstream end of the downstream segment of filter material 440. From the downstream end (or mouth end) of the filter 420, the segments preferably include a 5 mm long recess 470, a 10 mm long downstream segment of filter material 440 preferably in the form of a cellulose acetate (CA) plug, a 5 mm long cavity 450 containing a flavor bead 460, and a 5 mm long upstream segment of filter material 430 preferably in the form of another cellulose acetate (CA) plug.

Figure 5:
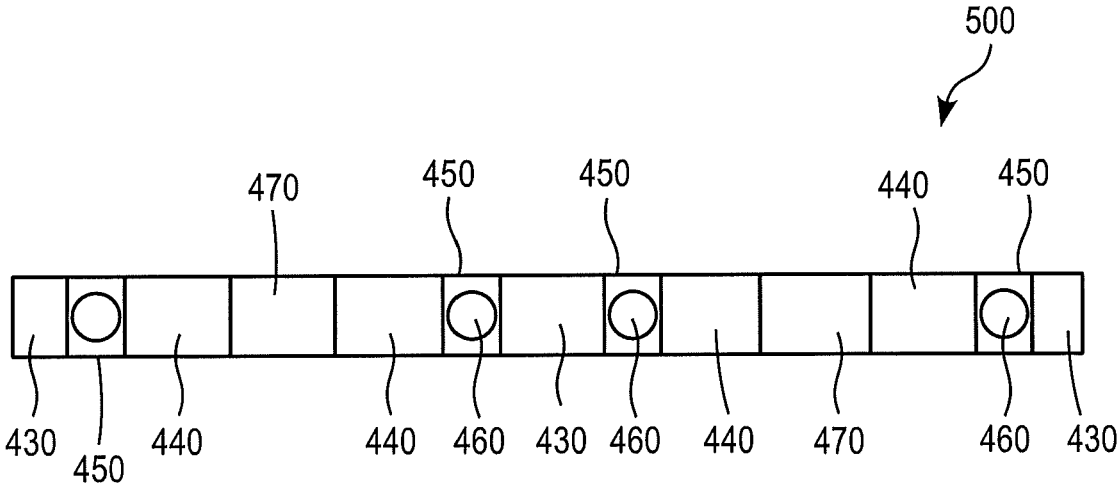
FIG. 5 is a cross-sectional view of a filter rod in accordance with another embodiment.

As shown in FIG. 5, a continuous filter rod 500 can be manufactured with repeating segments corresponding to the upstream segment of filter material 430, the cavity 450 containing a flavor bead 460, the downstream segment of filter material 440, and a recess 470, which is twice the cut or desired length of the recess 470, which is placed on the rod forming portion of the filter forming apparatus. Another downstream segment of filter material 440, a cavity 450 with flavor bead 460, an upstream segment of filter material 430, another cavity 450 with flavor bead 460, a downstream segment of filter material 440, a recess 470, which is twice the desired length of the recess 470, another downstream segment of filter material 440, another cavity 450 with flavor bead 460 and an upstream segment of filter material 430 are then added to the rod forming portion of the filter forming apparatus. The entire rod is circumscribed in a filter wrapper, and then cut into individual filter components 420 for assembly with a tobacco rod 410 to form a smoking article 400 as shown in FIG. 4.

As shown in FIG. 5, in accordance with an exemplary embodiment, the continuous rod 500 is about 100 mm in length and can be cut into four (4) filter components 420, which are about 25 mm in length. Each individual filter component 420 comprises a 5 mm recess 470, a 10 mm downstream segment of filter material 440, a 5 mm cavity 450 having a flavor bead 460 disposed therein, and a 5 mm upstream segment of filter material 430.

Figure 6:
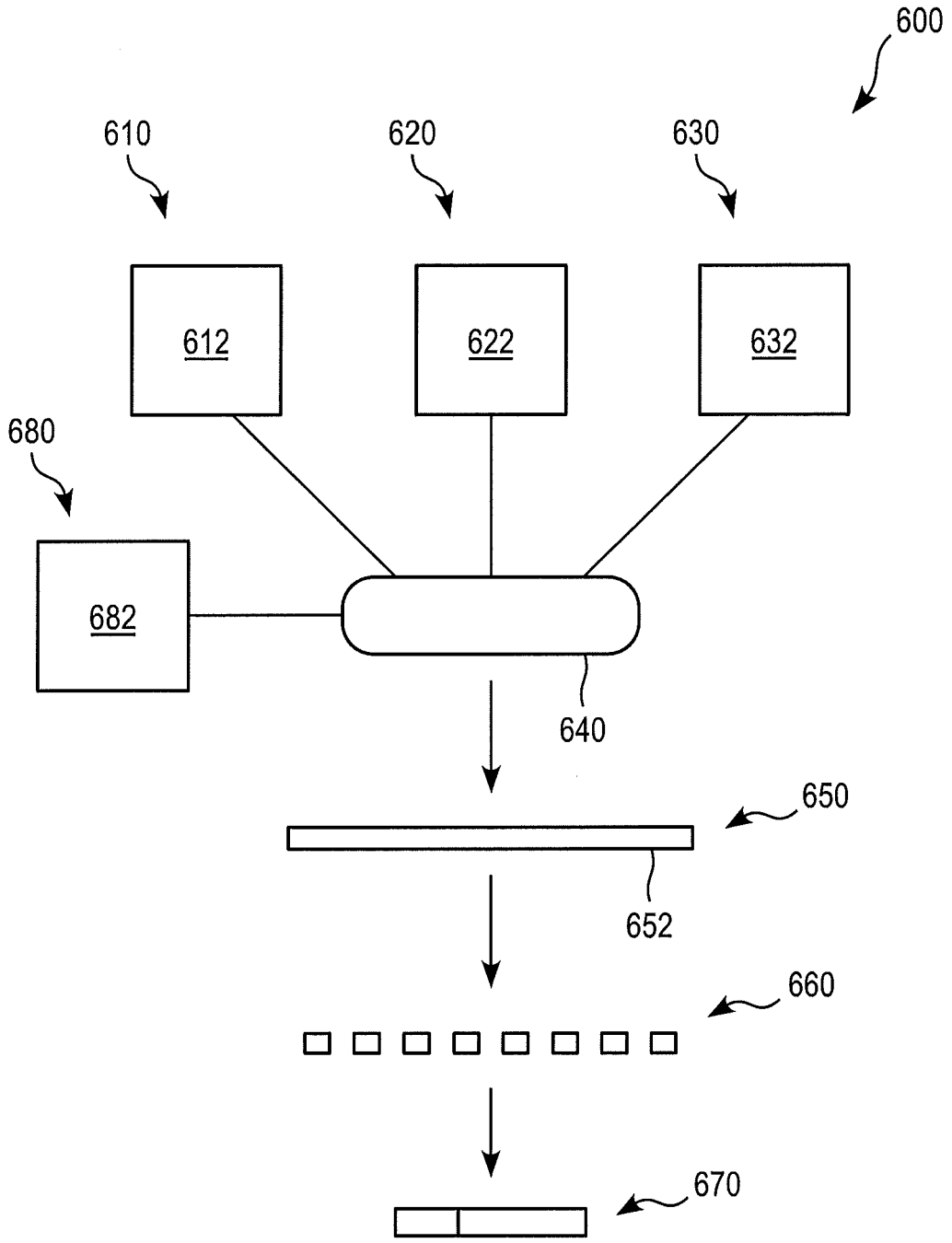
FIG. 6 is a cross-sectional view of a method of forming filter components in accordance with an exemplary embodiment.

In accordance with another exemplary embodiment, FIG. 6 shows a system 600 for manufacturing a filter (or filter component) 220, 420 and/or a continuous filter rod 300, 500 as shown in FIGS. 2-5. As shown in FIG. 6, the system 600 includes at least two hoppers 610, 620, which include filter segments preferably having a first length (i.e., first filter segment) 612 and a second length (i.e., second filter segment) 622, respectively, and a hopper 630 filled with flavor beads 632 of a desired diameter. The first and second filter segments 612, 622 are placed in a spaced apart relationship on a filter combiner 640 (or filter forming apparatus) so as to define a cavity therebetween. A flavor bead 632 is then placed in the cavity, and the process is repeated until a continuous filter rod 650 is formed. The filter segments 612, 622, and the individual flavor beads 632 are then wrapped with a filter wrapper 652 to form the continuous filter rod 650, which is then cut into individual filter components 660.

It can be appreciated that the flavor beads 632 can be placed or positioned within the cavity by any known method including dispensing, the flavor bead by gravitation force, vacuum assisted method, such as a vacuum wheel and/or other known methods of placing a spherical object or bead within a cavity.

The continuous filter rod 650 before cutting preferably includes at least two segments of the first filter segment 612, at least two segments of the second filter segment 622, and at least two flavor beads 632 in the cavity formed between the first filter segment and the second filter segment. The filter segments 612, 622 are then wrapped in a filter paper or plug wrap 652 and cut into a plurality of filter components 660 having at least one flavor bead 630 therein. The individual filter components 660 are assembled with a tobacco rod to form a smoking article 670.

In accordance with another exemplary embodiment, an additional hopper 680 can include a recessed filter segment 682, which is placed adjacent to either the first filter segment and/or the second filter segment as described and shown in FIGS. 4 and 5.

It should be understood that the foregoing description is of the preferred embodiments, and is merely representative of the article and methods of manufacturing the same. It can be appreciated that variations and modifications of the different embodiments in light of the above teachings will be readily apparent to those skilled in the art. Accordingly, exemplary embodiments, as well as alternative embodiments, may be made without departing from the scope of the articles and methods set forth in the attached claims.

What is claimed is:

1. A filter component for a smoking article, consisting of:

an upstream segment of filter material;

a downstream segment of filter material in a spaced apart relation to the upstream segment of filter material so as to define a cavity therebetween;

a single flavor bead disposed in the cavity, said flavor bead, wherein the flavor bead has an outer diameter, which is at least 75% of the spaced apart relation of the upstream segment of filter material and the downstream segment of filter material, and the outer diameter of the flavor bead does not exceed an outer diameter of either the upstream or the downstream segments of filter material;

a plug wrap circumscribing the upstream segment, the downstream segment and the single flavor bead;

a tipping paper circumscribing the plug wrap; and one or more circumferential rows of perforations through the plug wrap and the tipping paper at an upstream end portion of the filter.

2. The filter component of claim 1, wherein the upstream and the downstream segments of filter material each comprise a plug of cellulose acetate tow.

3. The filter component of claim 1, wherein the downstream segment of filter material has a length, which is at least twice a length of the upstream segment of filter material.

4. The filter component of claim 1, wherein the upstream segment of filter material ranges from about 5 mm to about 10 mm in length and wherein the downstream segment of filter material ranges from about 5 mm to about 20 mm in length.

5. The filter component of claim 1, wherein the flavor bead includes at least one flavor selected from the group consisting of lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, coffee and combinations thereof.

6. The filter component of claim 1, wherein the cavity ranges from about 5 mm to about 7 mm in length.

7. The filter component of claim 1, wherein the flavor bead is in the form of a spheroid having a diameter of about 4.5 mm to about 5 mm.

8. The filter component of claim 1, wherein the flavor bead is a polymer coated mentholated tobacco bead.

9. A smoking article comprising:

a tobacco rod; and a multi-component filter consisting of:

an upstream segment of filter material;

a downstream segment of filter material in a spaced apart relation to the upstream segment of filter material so as to define a cavity therebetween;

a single flavor bead disposed in the cavity, wherein the flavor bead has an outer diameter, which is at least 75% of the spaced apart relation of the upstream segment of filter material and the downstream segment of filter material and wherein the outer diameter of the flavor bead does not exceed an outer diameter of the upstream and downstream segments of filter material;

a plug wrap which circumscribes the upstream segment of filter material, the downstream segment of filter material and the flavor bead;

a tipping paper circumscribing the plug wrap; and one or more circumferential rows of perforations through the tipping paper and optionally through the plug wrap at an upstream end portion of the filter.

10. The smoking article of claim 9, wherein the flavor bead is in the form of a spheroid having a diameter ranging from about 4.5 mm to about 5 mm.

* * * * *